US005711098A

United States Patent [19]

Warne

[11] Patent Number: 5,711,098

[45] Date of Patent: Jan. 27, 1998

[54] FOLDING QUILTING FRAME WITH SUPPORT LEGS

[76] Inventor: Gregg L. Warne, 2228 W. Plata Cir., Mesa, Ariz. 85202

[21] Appl. No.: 517,203

[22] Filed: Aug. 22, 1995

[51] Int. Cl.[6] ..... D06C 3/08

[52] U.S. Cl. ..... 38/102.9; 38/102.91

[58] Field of Search ..... 38/102.9, 102.1, 38/102.3, 102.4, 102.6, 102.8, 102.7, 102.91; 108/162, 173, 115, 121, 129, 131, 132; 160/377, 382, 398, 404, 391, 393; 248/188.1, 188.6, 188.8

[56] References Cited

U.S. PATENT DOCUMENTS

| | | | |
|---|---|---|---|
| 672,809 | 4/1901 | Russell | 38/102.3 X |
| 825,375 | 7/1906 | Booth | 38/102.6 |
| 1,544,935 | 7/1925 | Preston | 108/131 |
| 1,666,622 | 4/1928 | Hess | 38/102.1 |
| 2,318,877 | 5/1943 | Meyer et al. | 38/102.6 |
| 2,684,275 | 7/1954 | Guth et al. | 108/131 |
| 4,658,521 | 4/1987 | Thorpe | 38/102.6 |
| 5,226,250 | 7/1993 | Ulmer et al. | 38/102.9 |

*Primary Examiner*—Ismael Izaguirre
*Attorney, Agent, or Firm*—Cahill, Sutton & Thomas P.L.C.

[57] ABSTRACT

A quilting frame employs two elongated rails each of which has a pair of legs hingedly attached thereto. Each leg has a foot pivotally mounted at its lower extremity. The pivotal mounting of each foot is such that when the foot is pivoted to a position parallel to the leg and the leg is swung to a position flush with the rail the foot lies alongside the rail.

5 Claims, 2 Drawing Sheets

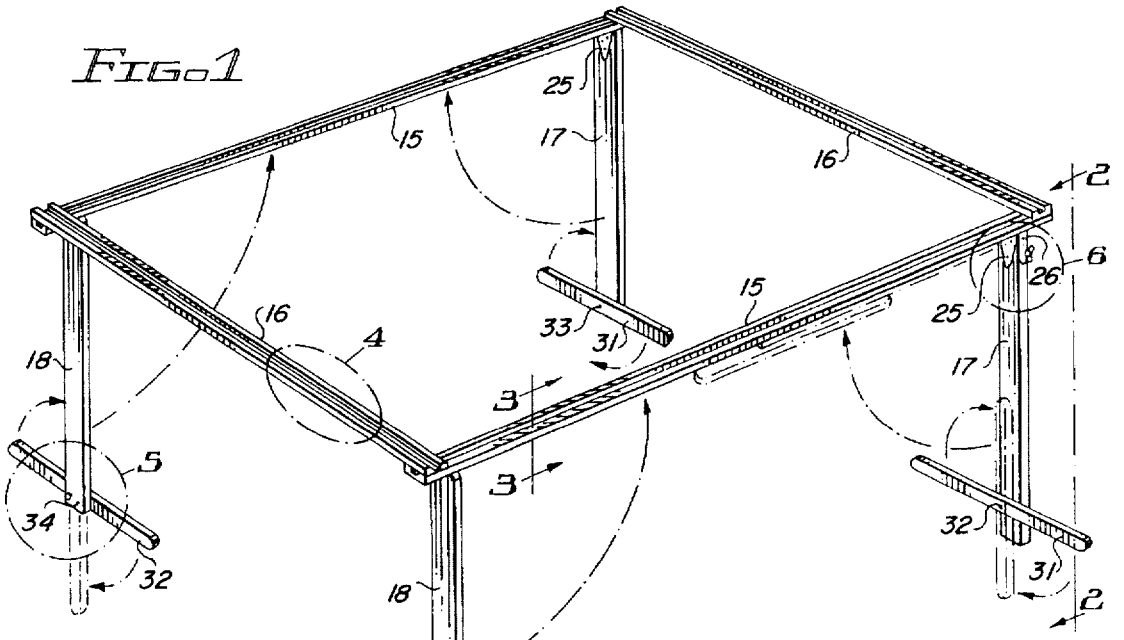
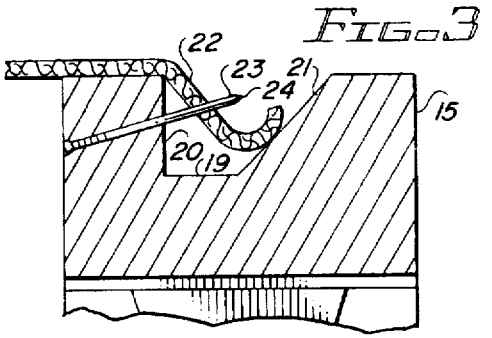
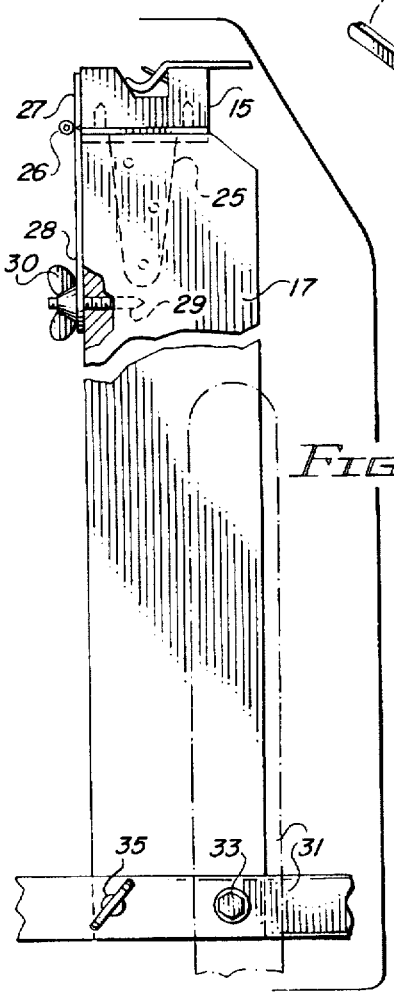
FIG. 2
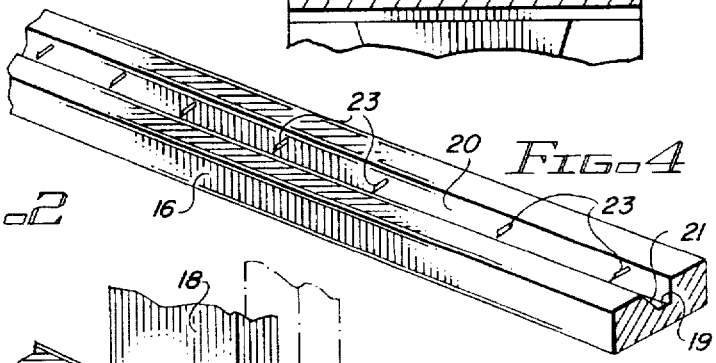
FIG. 4
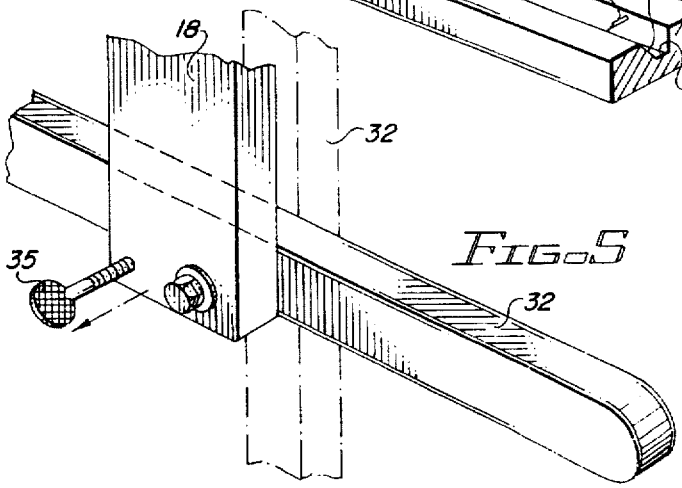
FIG. 5

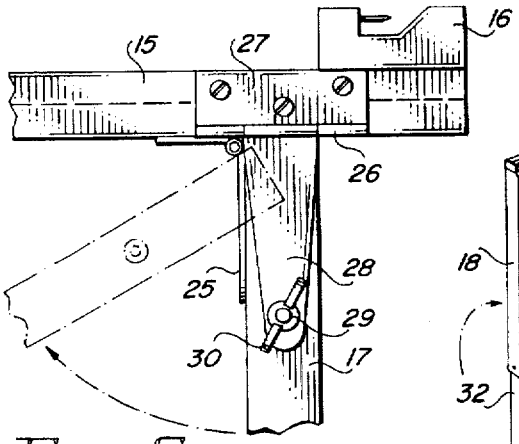
FIG. 6
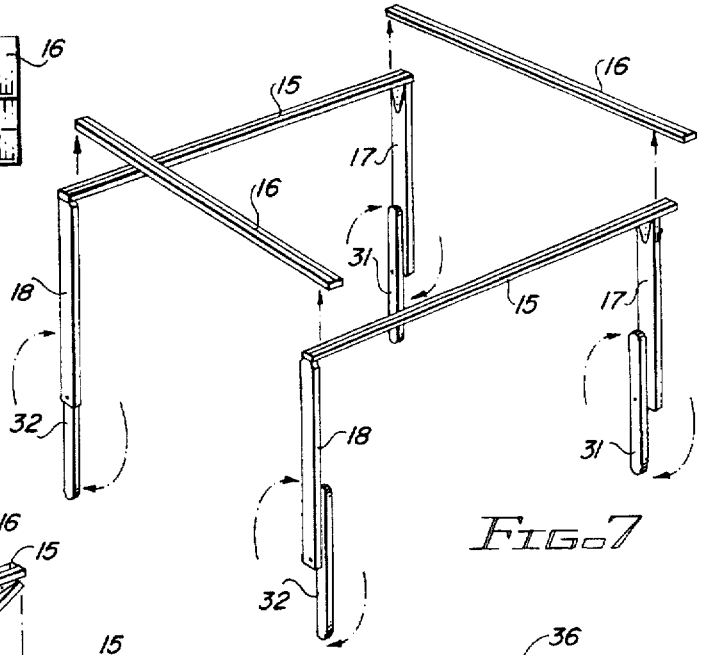
FIG. 7
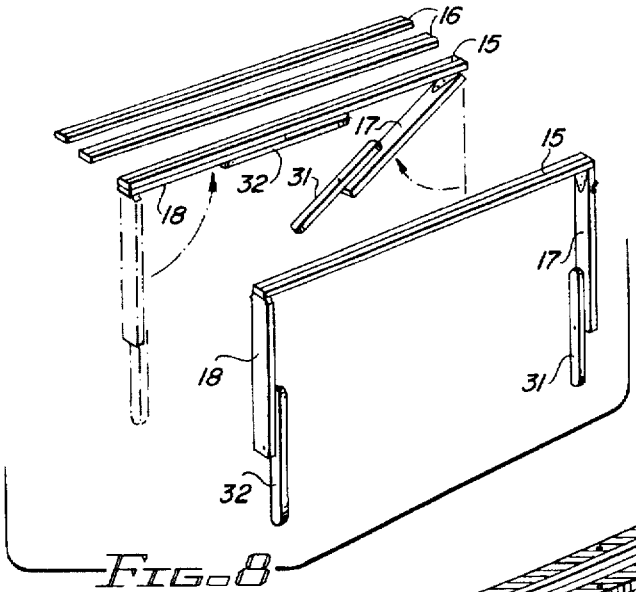
FIG. 8
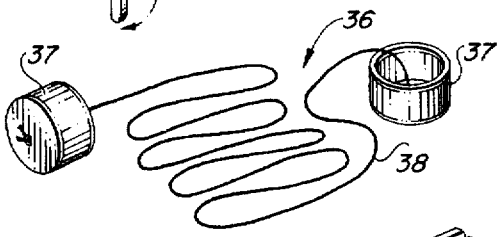
FIG. 10
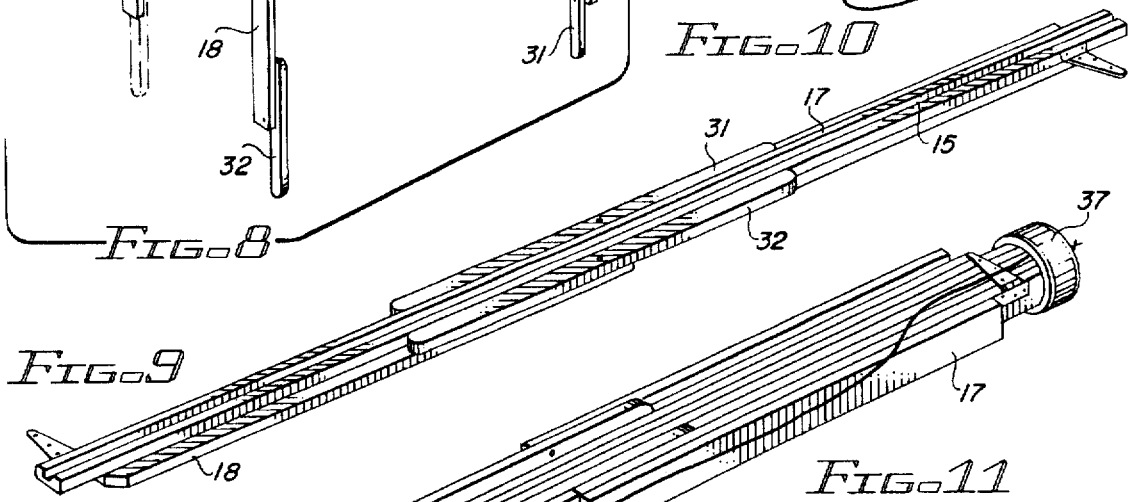
FIG. 9
FIG. 11

FOLDING QUILTING FRAME WITH SUPPORT LEGS

TECHNICAL FIELD

This invention is concerned with a frame for supporting a fabric sheet in a stretched condition. Such frames are commonly used for supporting the backing sheet of a quilt.

BACKGROUND ART

The quilting bee as a social institution was organized around the quilting frame, a wooden structure designed to hold a quilt taut during quilting. The frame was made from four 6 ft. to 10 ft. poles or rails, held together at its corners by pegs or clamps. The frame was supported by a stand, such as saw-horses, or on the backs of wooden chairs. Anywhere from eight to sixteen quilters could be accommodated at one sitting.

The quilting frame regardless of size occupies quite a bit of space when in use. So it is customary to dismantle the frame for storage when not in use and when it is to be transported from one location to another.

At least one pair of inventors has recognized the desirability of incorporating folding support legs into a quilting frame. Larry and Barbara Ulmer disclose such a frame in their U.S. Pat. No. 5,226,250 granted Jul. 13, 1993 for "Portable, Collapsible Craftwork Frame for Tensioning Textiles." The Ulmers make no provision, however, for dismantling the frame itself. Consequently, storage and transport of an Ulmer frame for large quilts poses serious problems.

The Ulmer patent contains a fairly comprehensive listing of patents disclosing various features of prior art quilting frames. Nevertheless there continues to be a need for a self-supporting quilting frame the components of which can be rearranged for compact storage and transport.

DISCLOSURE OF THE INVENTION

This invention contemplates a quilting frame employing two elongated rails each of which has a pair of legs hingedly attached thereto. Each leg has a foot pivotally mounted at its lower extremity. The pivotal mounting of each foot on each leg is such that when the foot is pivoted to a position parallel to the leg and the leg is swung to a position flush with the rail the foot lies alongside the rail. This is a very compact arrangement of frame components for storage and transport.

The frame of this invention further employs two additional rails which do not have legs or feet associated therewith. All four rails preferably include means for easily and reliably attaching the edges of the quilt backing to the rails. The attaching means preferably includes an elongated recess in the upper face of each rail and a plurality of pins spaced along the length of the recess. The pins extend transversely of the recess and have an exposed length less than the width of the recess.

BRIEF DESCRIPTION OF THE DRAWINGS

The invention is described in greater detail hereinafter by reference to the accompanying drawings wherein:

FIG. 1 is a perspective view of an erect quilting frame embodying the invention;

FIG. 2 is a side elevational view of a leg and foot structure employed in the frame, the leg is foreshortened;

FIG. 3 is an enlarged vertical section view through one rail of the frame taken generally as indicated by line 3—3 in FIG. 1;

FIG. 4 is an enlarged fragmentary perspective view of one of the rails of the frame taken generally as indicated by oval 4 in FIG. 1;

FIG. 5 is an enlarged, fragmentary, perspective view of a leg/foot connection for the frame taken generally as indicated by Circle 5 in FIG. 1;

FIG. 6 is an enlarged, fragmentary, elevational view of a leg/rail connection for the frame taken in the region indicated by Circle 6 in FIG. 1;

FIG. 7 is a perspective view illustrating the initial steps in dismantling the frame;

FIG. 8 is a perspective view illustrating further steps in the dismantling and rearranging of the components of the frame;

FIG. 9 is a perspective view of one rail of the frame with the legs and feet attached thereto folded in position for storage or transport;

FIG. 10 is a perspective view of a carrying device for the dismantled frame; and FIG. 11 is a perspective view showing the dismantled frame packaged as a kit for transport.

BEST MODE FOR CARRYING OUT THE INVENTION

Referring particularly to FIG. 1, the quilting frame of this invention when erected provides a rectangular support for holding a tensioned sheet of fabric, namely the backing sheet for a quilt. The frame comprises two pairs of rails 15 and 16. Rails 15 can be considered to be front and rear rails and rails 16 can be considered to be side rails. The two pairs of rails 15 and 16 are distinguished by the fact that the front and rear rails 15 have support legs 17 and 18 attached thereto, whereas side rails 16 are plain, i.e. have no legs.

Rails 15 and 16 are made from hardwood and may have lengths of six feet to ten feet depending upon the size of quilt to be accommodated thereon. Side rails 16 are adapted to rest on front and rear rails 15 providing for relative movement of the rails to permit the frame dimensions to be adjusted to the precise size of the quilt. Once the rails have been positioned relative to each other their overlapping sections at their ends are secured together by any suitable releasable means, such a C-clamps (not shown).

In accordance with this invention each rail 15 and 16 is configured to receive and hold edge regions of the quilt backing sheet. That configuration is best illustrated in FIGS. 3 and 4. Each rail 15 and 16 has an elongated recess 19 in its upper face and extending along the length of the rail. One side wall of each recess 19 is substantially upright. This side wall is nearest the interior of the frame and is designated by reference numeral 20. The opposite side wall 21 slopes upwardly and outwardly from side wall 20.

A backing sheet 22 is held in a recess 19 of one of the rails by a series of pins 23 spaced along the recess (See FIG. 4). Each pin 23 has a sharp distal end 24 which extends toward but is out of contact with opposite side wall 21 of the recess 19. In other words, the exposed length of the pins is less than the width of the recess at the level of the pins.

It should be noted that the exposed length of each pin 23 is entirely within the recess 19 so that its sharp end 24 does not project above the top surface of the rail. Such placement precludes accidental contact with the pins by the quilter working above the frame.

One convenient way of providing the pins 23 is to drive brads through the inner wall of the rail so that the ends of the brads protrude into the recess 19 (See FIG. 3 ).

Attachment of the edges of the backing sheet 22 to the rails is a simple procedure. The quilter grasps an edge region of the sheet between thumb and forefingers and slides the grasped portion down the sloping sidewall 21 of a recess 19 until that portion of the sheet is impaled on several pins 23. This process is repeated until all of the edges of the sheet have been attached to rails 15 and 16.

Another important feature of the quilting frame of this invention is the provision of a foldaway support structure for the front and rear rails 15. As mentioned previously, the front and rear rails each have two legs 17 and 18 attached to the rails near their ends. Attachment is by means of hinges 25 secured to the inner faces of the legs 17 and 18 and the under face of rails 15. The hinges 25 permit the legs 17 and 18 to swing upward and inwardly until the inner face of each leg 17 and 18 is flush against the bottom face of their respective rails 15. The combined lengths of legs 17 and 18 are less than the distance between the pivot axes of hinges 25 so there is no interference between the legs when they are swung up.

Each leg 17 and 18 for each rail 15 is stabilized, i.e. locked, in its upright support position by a hingedly mounted bracket 26. Each hinge bracket 26 has an upper leaf 27 secured as by screws to a side face of the rail 15. Each leaf 27 is hingedly connected to an elongated lower leaf 28. Each lower leaf 28 has an opening through its lower neck region for receiving a stud bolt 29 screwed into its leg 17 or 18. A wing nut 30 on each stud bolt 29 tightly clamps the lower leaf of hinge bracket 26 against its leg 17 or 18 securely holding the leg in upright position substantially at right angles to its rail. (See FIGS. 2 and 6).

To release each leg 17 or 18 so that it may be folded for storage or transport the wing nut 30 for that leg is removed from its stud bolt 29 and bracket leaf 28 is lifted clear of the stud bolt freeing the leg for movement. Thereafter, the bracket leaf 28 can be folded up against the upper leaf 27 of bracket hinge 26 for more compact storage.

To further stabilize the quilting frame when in use it is desirable to provide legs 17 and 18 at their lower extremities with feet designated, respectively, 31 and 32. Each foot 31 is pivotally connected by a bolt 33 to its respective leg 17 and each foot 32 is pivotally connected by a bolt 34 to its respective leg 18. Bolts 33 and 34 permit feet 31 and 32 to be swung from a substantially horizontal position at right angles to their respective legs to an upright, second position substantially parallel to their respective legs.

Each leg 17 and 18 is somewhat wider at its lower end than the rail 15 to which it is connected and the bolts 33 and 34 are so positioned that when the feet 31 and 32 are moved to their second, parallel position they will clear the rail 15 when the legs are swung upwardly against the rail. The arrangement is such that a foot 31 on a leg 17 lies on one side of the rail 15 and the foot 32 on the other leg 18 lies on the opposite side of rail 15. Again, there is no interference to prevent legs 17 and 18 from being moved to a compact position against their rails 15.

Each foot 31 and 32 has means associated therewith for locking it in horizontal position when the frame is in use. This locking means may take the form of a thumb screw 35. In locked condition, a thumb screw 35 extends through a hole in each leg 17 and 18 and into foot 31 or 32 associated with a particular leg. Removal of thumb screws from the feet 31 and 32 permits the feet to be pivoted on their respective bolts 33 and 34.

FIGS. 7 and 8 illustrate a progression of the dismantling of the quilting frame. And FIG. 9 shows one of the rails 15 with its support legs 17 and 18 and its feet 31 and 32 folded into a very compact condition.

FIG. 11 illustrates how the rail 15 with folded support legs 17 and 18 can be arranged in parallel relationship with the two side rails 16 sandwiched therebetween. In this condition the components can be regarded as a compact "kit" from which a sturdy, reliable quilting frame can be erected.

The kit of FIG. 11 can be easily transported by means of sling 36 shown in FIGS. 10 and 11. The sling comprises a pair of end caps 37 sized to fit snugly over the ends of the four rails 15 and 16. A flexible halter 38 connects the end caps 38 and functions to hold the end caps in place on the bundle of rails 15 and 16 and to serve as a carrying handle.

From the foregoing it should be apparent that this invention provides a sturdy quilting frame which is reliable and easily used and stored or transported.

What is claimed is:

1. In a quilting frame, an elongated rail, a first leg having one end hingedly attached to said rail near one end of the rail, said leg being movable between one position at a substantially right angle to the rail and a second position lying flush against the rail, and a first foot pivotally mounted to the other end of said leg, said foot being movable between one position in which the foot is normal to said leg and a second position in which the foot is substantially parallel to the leg, the pivotal mount for said foot being positioned such that when each of the leg and the foot are in their respective second positions said foot is positioned alongside and parallel to the rail, said rail having a longitudinal recess in the upper face thereof and a plurality of pins in said recess and spaced along the length of the recess, said pins extending transversely of the recess and having an exposed length less than the width of the recess.

2. The quilting frame of claim 1 in which said recess has a generally upright side wall and an opposite side wall which slopes upwardly and away from the upright side wall, and said pins project from said upright side wall toward said opposite side wall.

3. In a quilting frame, an elongated rail, a first leg having one end hingedly attached to said rail near one end of the rail, said leg being movable between one position at a substantially right angle to the rail and a second position lying flush against the rail, and a first foot pivotally mounted to the other end of said leg, said foot being movable between one position in which the foot is normal to said leg and a second position in which the foot is substantially parallel to the leg, the pivotal mount for said foot being positioned such that when each of the leg and the foot are in their respective second positions said foot is positioned alongside and parallel to the rail, a second leg having one end hingedly attached to said rail near the opposite end of the rail, said second leg being movable between one position at a substantially right angle to the rail and a second position lying flush against the rail, said first leg and said second leg having combined lengths less than the distance between the points of attachment of the two legs to the rail, and a second foot pivotally mounted to the other end of said second leg, said second foot being moveable between one position in which the second foot is normal to said second leg and a second position in which the second foot is substantially parallel to the second leg, the pivotal mount for said second foot being positioned such that when each of the second leg and the second foot are in their respective second positions said second foot is positioned alongside of the rail on the side opposite the side along which the said first foot is positioned.

4. A quilting frame kit comprising two sets of the components set forth in claim 3 together with third and fourth rails without legs and feet.

5. The quilting frame kit of claim 4 in which the four rails are bundled in parallel relationship to each other and cap members encompass the ends of the bundled rails and a flexible carrying member connects said cap members.

* * * * *